US010029218B2

(12) United States Patent
Mason et al.

(10) Patent No.: US 10,029,218 B2
(45) Date of Patent: Jul. 24, 2018

(54) METHOD AND SYSTEM FOR A SHORT LENGTH JET PUMP WITH IMPROVED MIXING

(71) Applicant: General Electric Company, Schenectady, NY (US)

(72) Inventors: Jeffrey Lee Mason, Sharonville, OH (US); Ronald Bruce Schofield, Clarksville, OH (US); Seth Michael Ray, Wyoming, OH (US); Benjamin James Schumacher, Cincinnati, OH (US); James Fitzgerald Bonar, Cincinnati, OH (US); George Elliott Moore, Lebanon, OH (US)

(73) Assignee: General Electric Company, Schenectady, NY (US)

( * ) Notice: Subject to any disclaimer, the term of this patent is extended or adjusted under 35 U.S.C. 154(b) by 582 days.

(21) Appl. No.: 14/601,295

(22) Filed: Jan. 21, 2015

(65) Prior Publication Data

US 2016/0207011 A1 Jul. 21, 2016

(51) Int. Cl.
*B01F 5/02* (2006.01)
*B01F 15/02* (2006.01)
(Continued)

(52) U.S. Cl.
CPC ..... *B01F 5/0256* (2013.01); *B01F 3/02* (2013.01); *B01F 15/0254* (2013.01); *F04F 5/10* (2013.01);
(Continued)

(58) Field of Classification Search
CPC ..... B01F 5/0256
(Continued)

(56) References Cited

U.S. PATENT DOCUMENTS 2,382,688 A * 8/1945 Wilson ..... B05B 1/267 239/428.5
3,134,338 A 5/1964 Dodge
(Continued)

FOREIGN PATENT DOCUMENTS

CN 87105403 A 2/1988
CN 2049291 U 12/1989
EP 1980717 A2 10/2008

OTHER PUBLICATIONS

European Search Report and Opinion issued in connection with corresponding EP Application No. 16151886.5 dated May 23, 2016.
(Continued)

*Primary Examiner* — David Sorkin
(74) *Attorney, Agent, or Firm* — General Electric Company; Brian Overbeck

(57) ABSTRACT

A method and system for a jet pump is provided. The jet pump system includes a pre-mixing bowl includes a nozzle, a mixing section at least partially surrounding the nozzle, and a first inlet opening configured to receive a first flow of fluid and direct the first flow of fluid to an inlet of the nozzle. The pre-mixing bowl further includes a second inlet opening configured to receive a second flow of fluid and to direct the second flow of fluid to the mixing section. The second inlet opening includes a first inlet opening area. The second inlet opening includes an entry angle into the pre-mixing bowl that is oblique with respect to the central axis. The pre-mixing bowl further includes a third inlet opening configured to receive a third flow of fluid to direct the third flow of fluid to the mixing section.

18 Claims, 10 Drawing Sheets

(51) Int. Cl.

| | |
|---|---|
| ***B01F 3/02*** | (2006.01) |
| ***F04F 5/10*** | (2006.01) |
| ***F04F 5/46*** | (2006.01) |
| ***F04F 5/54*** | (2006.01) |
| *B01F 5/00* | (2006.01) |

(52) U.S. Cl.
CPC ..... *F04F 5/46* (2013.01); *F04F 5/54* (2013.01); *B01F 2005/0017* (2013.01)

(58) Field of Classification Search
USPC ..... 366/163.2; 137/888, 889
See application file for complete search history.

(56) References Cited

U.S. PATENT DOCUMENTS

| | | | | |
|---|---|---|---|---|
| 3,185,107 | A | 5/1965 | Dodge | |
| 3,643,688 | A * | 2/1972 | Meinert | B67D 1/0016 137/556 |
| 4,543,900 | A | 10/1985 | Aker | |
| 4,940,392 | A | 7/1990 | Adkins | |
| 5,322,222 | A | 6/1994 | Lott | |
| 6,523,991 | B1 * | 2/2003 | Maklad | B01F 5/0403 137/889 |
| 6,802,638 | B2 * | 10/2004 | Allen | B01F 5/0475 366/152.1 |
| 7,416,326 | B2 * | 8/2008 | Sakata | A61L 2/18 137/889 |
| 8,099,973 | B2 | 1/2012 | Sampson et al. | |
| 8,192,070 | B2 * | 6/2012 | Allen | B01F 3/1228 366/132 |
| 8,465,264 | B2 | 6/2013 | Sampson et al. | |
| 2006/0070675 | A1 * | 4/2006 | Hsu | B01F 3/0446 137/888 |
| 2010/0170574 | A1 | 7/2010 | Fauque et al. | |
| 2003/0323089 | | 12/2013 | Han | |
| 2016/0222986 | A1 | 8/2016 | Mason et al. | |

OTHER PUBLICATIONS

Machine translation and Office Action issued in connection with Corresponding CN Application No. 201610039377.7 dated Jun. 28, 2017.

* cited by examiner

METHOD AND SYSTEM FOR A SHORT LENGTH JET PUMP WITH IMPROVED MIXING

BACKGROUND

The field of the disclosure relates generally to jet pumps and, more particularly, to a jet pump having fully mixed flow in a distance less than four diameters of the mixing tube length.

At least some known aircraft air management systems (AMS) include supply sources for high-pressure (HP), low-pressure (LP), and mixed mode bleed levels. Typically, the HP and LP flows are supplied directly from a bleed port on a respective engine. Mixed mode bleed is supplied through a jet pump. The jet pump receives both HP and LP air flow, mixes the flows in selectable proportions and delivers the mixed mode bleed air to the AMS. Newer engines tend to have constrained space requirements that do not permit the use of standard architecture jet pump components and simply scaling the standard architecture jet pumps will not be able to mix the HP and LP flows adequately.

BRIEF DESCRIPTION

In one embodiment, a jet pump system includes a pre-mixing bowl that includes a nozzle along a central axis with a mixing section at least partially surrounding the nozzle. The pre-mixing bowl also includes a first inlet opening configured to receive a first flow of fluid from a first pressurized fluid source and direct the first flow of fluid to an inlet of the nozzle, a second inlet opening configured to receive a second flow of fluid from a second pressurized fluid source and to direct the second flow of fluid to the mixing section. The second inlet opening includes a first inlet opening area and an entry angle into the pre-mixing bowl that is oblique with respect to the central axis, and a third inlet opening configured to receive a third flow of fluid from the second pressurized fluid source and to direct the third flow of fluid to the mixing section. The third inlet opening including a second inlet opening area and an entry angle into the pre-mixing bowl that is oblique with respect to the central axis. The pre-mixing bowl also includes an outlet opening configured to direct the first, second and third flows of fluid from the pre-mixing bowl. The jet pump system further includes a mixing tube extending from the outlet opening aligned with the central axis.

In another embodiment, a method of supplying air at a plurality of different flows and a plurality of different pressures. The method includes channeling a first flow of relatively high pressure fluid to an inlet of a nozzle of a pre-mixer and channeling at least one of a plurality of flows of relatively low-pressure fluid and a second flow of relatively high-pressure fluid into a mixing section of the pre-mixer. The low pressure flows being of unequal flow rate and unequal flow velocity. The flows channeled through a respective arcuate path prior to entering the mixing section such that each of the plurality of flows of relatively low-pressure fluid has a flow gradient across the respective flows upon entry into the mixing section. The method also includes mixing the flow of relatively high-pressure fluid and the plurality of flows of relatively low-pressure fluid in the mixing section downstream of the nozzle as well as blocking the first flow of relatively high-pressure fluid to an inlet of a nozzle of the pre-mixer allowing the plurality of second flows of relatively lower pressure fluid into the mixing section such that only relatively low-pressure fluid enters the pre-mixer, and blocking the plurality of flows of relatively low-pressure fluid into the mixing section such that only the flow of relatively high-pressure fluid enters the pre-mixer.

In yet another embodiment, an aircraft includes an air management system (AMS) that includes a jet pump apparatus. The jet pump apparatus includes a pre-mixing bowl having a nozzle along a central axis, a pre-mixing section at least partially surrounding the nozzle, a first inlet opening configured to receive a first flow of fluid from a first pressurized fluid source and direct the first flow of fluid to an inlet of the nozzle, and a second inlet opening configured to receive a second flow of fluid from a second pressurized fluid source and to direct the second flow of fluid to the mixing section. The second inlet opening including a first inlet opening area and an entry angle into the pre-mixing bowl that is oblique with respect to the central axis. The pre-mixing bowl includes a third inlet opening configured to receive a third flow of fluid from the second pressurized fluid source and to direct the third flow of fluid to the mixing section. The third inlet opening including a second inlet opening area and an entry angle into the pre-mixing bowl that is oblique with respect to the central axis and an outlet opening configured to direct the first, second and third flows of fluid from the pre-mixing bowl. The jet pump apparatus further includes a mixing tube extending from the outlet opening aligned with the central axis.

DRAWINGS

These and other features, aspects, and advantages of the present disclosure will become better understood when the following detailed description is read with reference to the accompanying drawings in which like characters represent like parts throughout the drawings, wherein.

Figure 1:
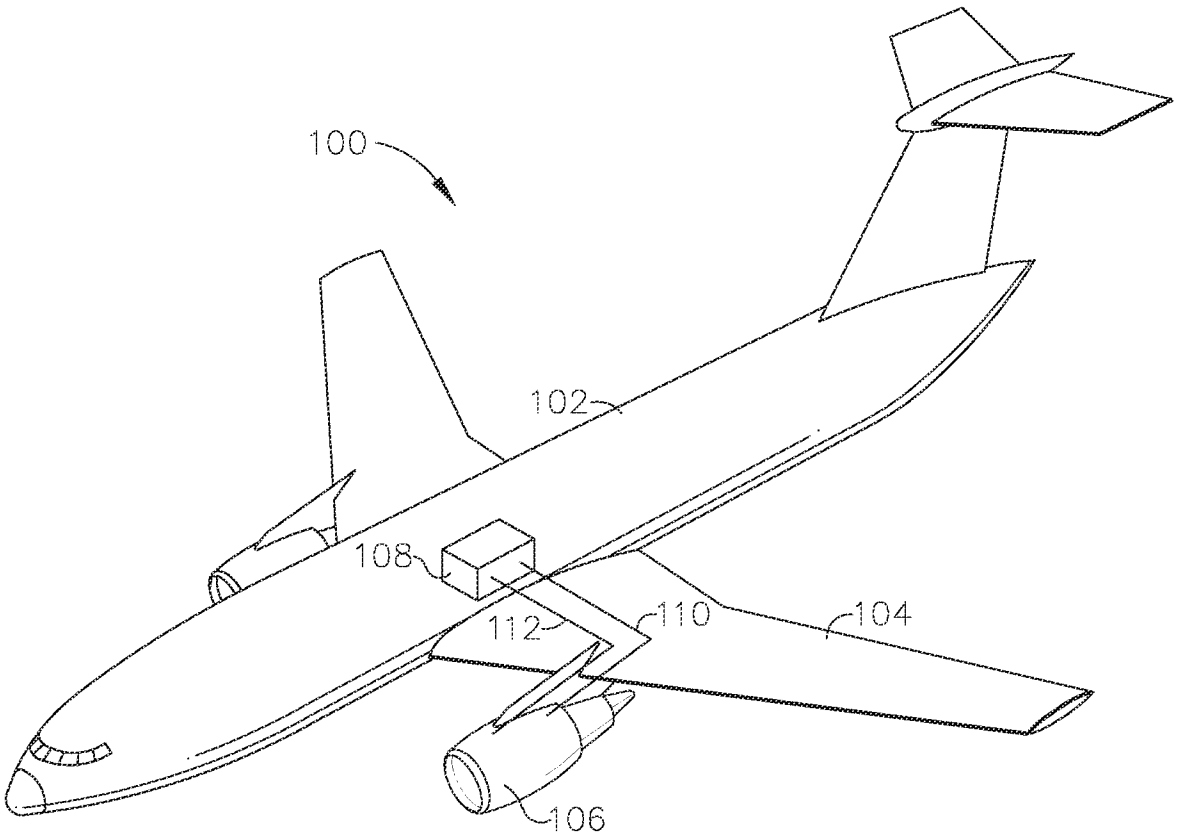
FIG. 1 is a perspective view of an aircraft including a fuselage and a wing in accordance with one example embodiment of the present disclosure.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

The jet pump systems described herein provide a cost-effective method for providing mixed mode bleed air to an air management system (AMS) using a shorter length mixing tube than is currently available. Simply scaling down a standard architecture jet pump does not provide adequate mixing. The jet pump described herein is capable of having fully mixed flow in a distance less than four diameters of a length of a mixing tube portion of the jet pump. The embodiments described herein use high-pressure compressor (HPC) bleed from a fourth stage, relatively low-pressure port and/or tenth stage, relatively high-pressure port of a gas turbine engine compressor for the aircraft environmental control system (ECS) and Wing Anti-Ice (WAI). In the example embodiment, bleed from the fourth stage can be up to approximately 10% of core air flow and up to approximately 15% of core air flow from the tenth stage. Under certain conditions neither stage can deliver a required air pressure wherein the fourth stage operates below a first pressure/temperature limit and the tenth stage operates above a second pressure/temperature limit. Mixing the fourth stage and tenth stage bleed air is used to supply air between the capabilities that the fourth stage and tenth stage bleed air can supply alone. Specifically, the embodiments described herein use one or more of the following features to provide fully developed mixed flow in less than four diameters of the mixing section entrance. Namely, the features include upstream duct bends that promote non-uniform flow field between the multiple inlets and promote swirl in the flow of low-pressure air, without use of swirl vanes. Multiple low-pressure inlets of different diameters (but close to 50-50 flow split) allow the higher velocity LP leg to pre-swirl the lower velocity LP leg prior to HP flow introduction (i.e. preboost LP flow and produce better swirl in mixing duct), and multi-inlets arranged at an angle to mixed flow direction to balance swirl with flow performance requirements (minimize losses in LP stream). The feature also include a pre-mixing bowl to minimize total pressure losses and promote efficient swirl generation, pre-swirl to facilitate maintaining HP center jet coherence at mixing section entrance, allowing a shorter central nozzle, which is lighter weight, increases effective mixing length, lessens LP losses, and improves backflow margin. The features of the disclosed jet pump system further include a conic central nozzle that improves swirl generation by inducing the non-uniform inlet flow fields to flow around a central blockage in the mixing section downstream of the nozzle outlet, an HP nozzle is designed to maximize flow shear between the LP and the HP flow using a nozzle having lobes of various configurations, which approximates a compact and light-weight multi-port nozzle. The helix-lobed nozzle configuration generates additional HP swirl and additional mixing effectiveness in a relatively shorter mixing section than previous designs. The helix-lobed nozzle further provides additional LP swirl at the same time. The jet pump system described herein operates efficiently across the entire range of engine power levels, and across a broad range of LP/HP pressure ratios, which enables an HP pressure regulation strategy directed toward engine or jet pump efficiency, depending on which benefit is desired at al time.

FIG. 1 is a perspective view of an aircraft 100 including a fuselage 102 and a wing 104. Although illustrated and described in FIG. 1 as an under-wing engine, it should be understood that the disclosure has similar applicability to fuselage mounted engines and skid or hard mounted engines as well. A gas turbine engine 106 is coupled to wing 104 and is configured to supply propulsive power to aircraft 100 and may be a source of auxiliary power to various systems of aircraft 100. For example, gas turbine engine 106 may supply electrical power and pressurized air to the various systems. In one example, gas turbine engine 106 supplies pressurized air to an aircraft air management system (AMS) 108. In various embodiments, gas turbine engine 106 supplies a relatively higher pressure air through a first high-pressure conduit 110 and relatively lower pressure air through a second low-pressure conduit 112. In other embodiments, the relatively higher pressure air, the relatively lower pressure air, and a combination of the relatively higher pressure air and the relatively lower pressure air is generated proximate gas turbine engine 106 and channeled to AMS 108 through a single conduit, for example, first high-pressure conduit 110 or second low-pressure conduit 112.

Figure 2:
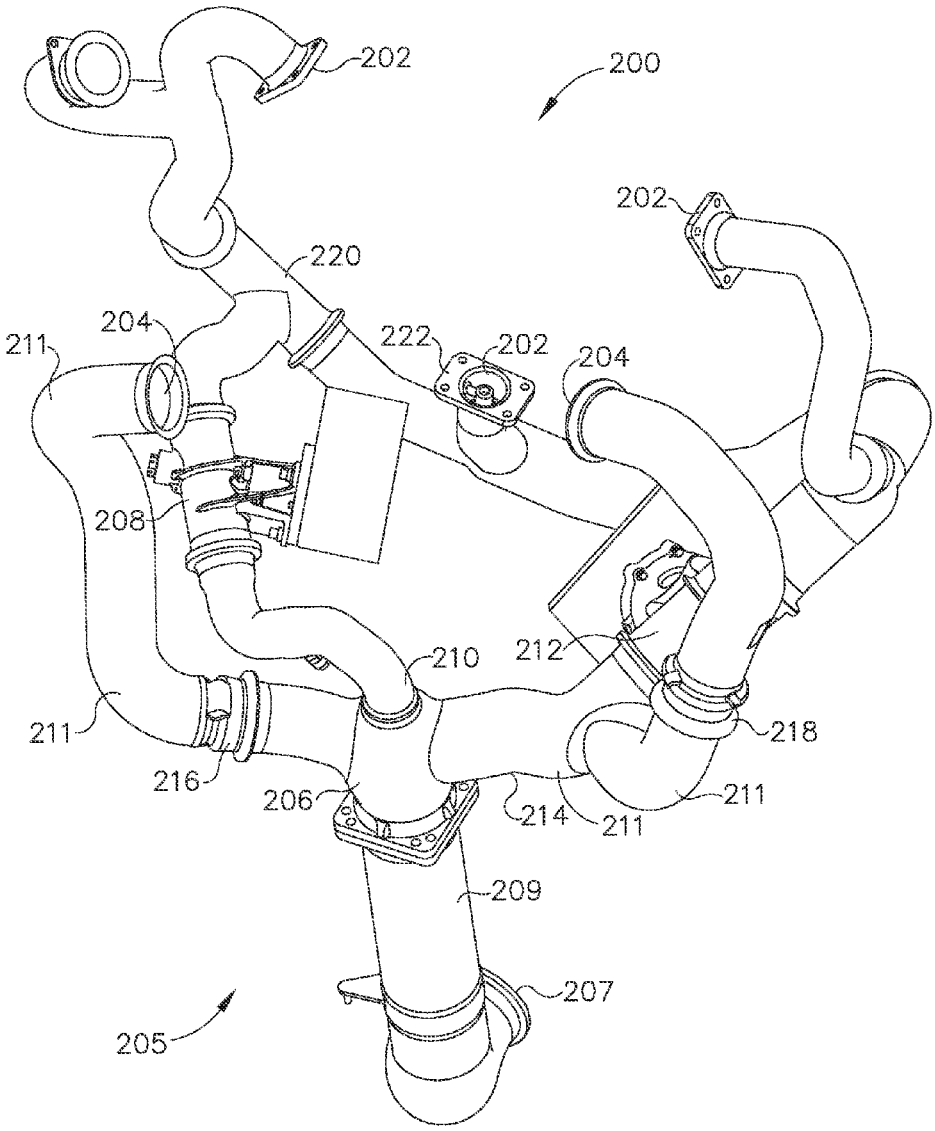
FIG. 2 is a three dimensional (3D) isometric piping view of an aircraft air management system (AMS) supply source.

FIG. 2 is a three dimensional (3D) isometric piping view of an aircraft air management system (AMS) supply source 200. AMS supply source 200 includes a high-pressure (HP) source, such as, but not limited to one or more compressor $10^{th}$ stage bleed ports 202, low-pressure (LP) source, such as, but not limited to one or more compressor $4^{th}$ stage bleed ports 204. Air from various combinations of ports 202 and 204 provide high-pressure, low-pressure, and mixed mode flows to a jet pump 205, which is supplied through a jet pump outlet 207 to a downstream AMS. Typically, the HP and LP flows are supplied directly from bleed ports 202 and 204 from a respective engine. A mixed mode bleed is supplied through a jet pump 205. Jet pump 205 receives both HP and LP air flow, mixes the flows in selectable proportions in a pre-mixing bowl 206 and delivers the mixed mode bleed air to the AMS through a mixing tube 209. Upstream duct bends 211 promote a non-uniform flow field between the multiple inlets, promoting swirl in the low-pressure flows without the use of swirl vanes.

A jet pump shutoff valve (JPSOV) 208 modulates to supply high-pressure air to a throat 210 of jet pump 205. A high-pressure shutoff valve (HPSOV) 212 modulates to supply high-pressure air from $10^{th}$ stage ports 202 to a first inlet 214. Check valves 216 and 218 prevent back flow from $10^{th}$ stage ports 202 to $4^{th}$ stage bleed ports 204.

AMS supply source 200 operates in three modes where outlet 207 is supplied from low-pressure $4^{th}$ stage bleed ports 204, from high-pressure bleed ports 202, and a mixed supply from both low-pressure $4^{th}$ stage bleed ports 204 and high-pressure bleed ports 202. In a first mode, outlet 207 is supplied from low-pressure $4^{th}$ stage bleed ports 204 with both JPSOV 208 and HPSOV 212 in a closed position. In a second mode, outlet 207 is supplied from high-pressure bleed ports 202 with JPSOV 208 in a closed position and HPSOV 212 in an open position. A third mode is a jet pump mode where HPSOV 212 is in a closed position and JPSOV 208 is in an open position. When in the open position, JPSOV 208 modulates to adjust flow from a single leg of the high-pressure supply portion 220 of AMS supply source 200.

A flow sensor is configured to measure an amount of the extracted flow from the $10^{th}$ stage is going to AMS supply source 200. The $10^{th}$ stage bleed measurement is used to maintain an operation of engine 106 according to a predetermined air management schedule. Bleeding air from the $10^{th}$ stage may affect other stages of engine 106. A map of a range of $10^{th}$ stage flow rates is used to determine an impact for the various flow rates on engine 106. The $10^{th}$ stage bleed flow rate is accounted for in thrust schemes and fielding schemes that affect a performance of engine 106.

Figure 3:
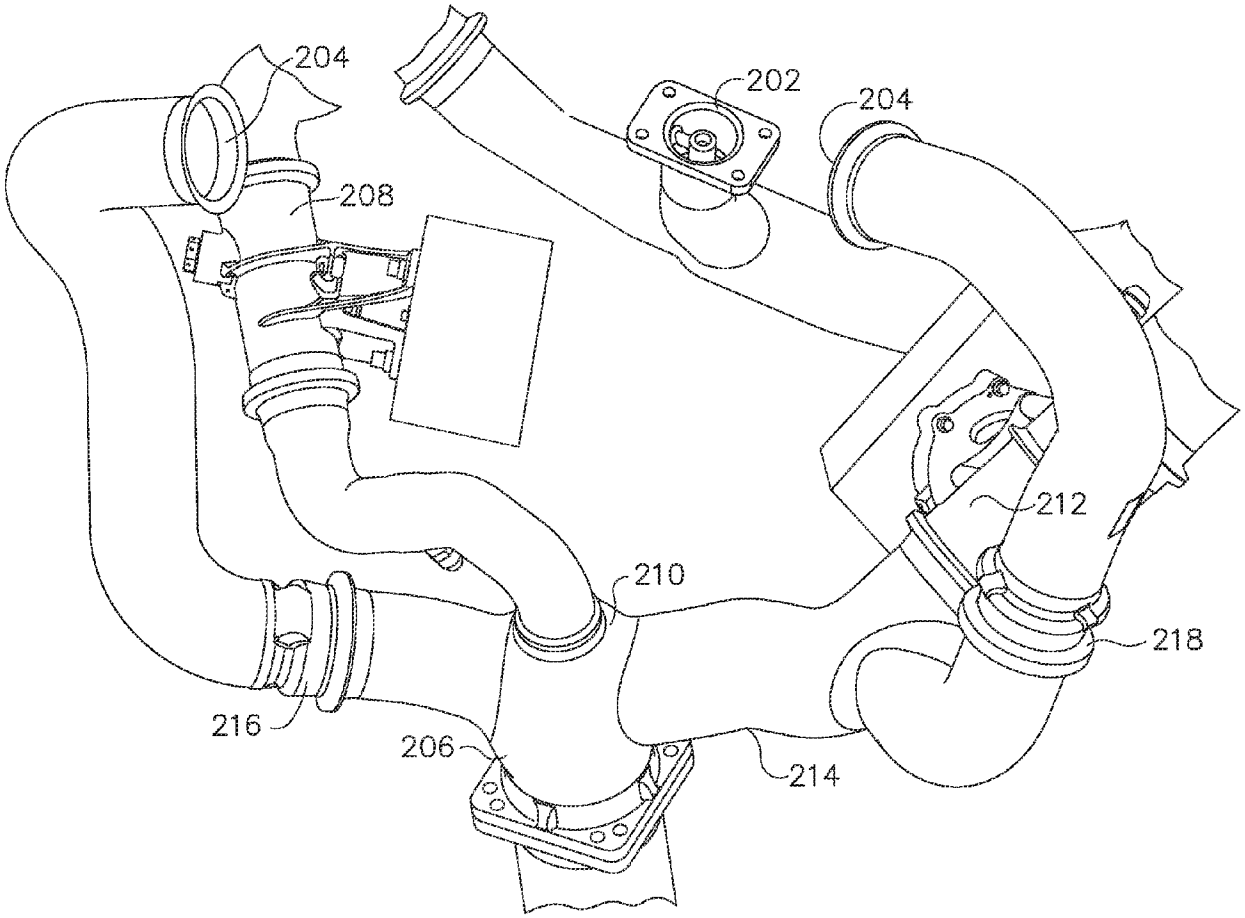
FIG. 3 is a three dimensional (3D) isometric piping view of a portion of the aircraft air management systems (AMS) supply source shown in FIG. 2.
Figure 4:
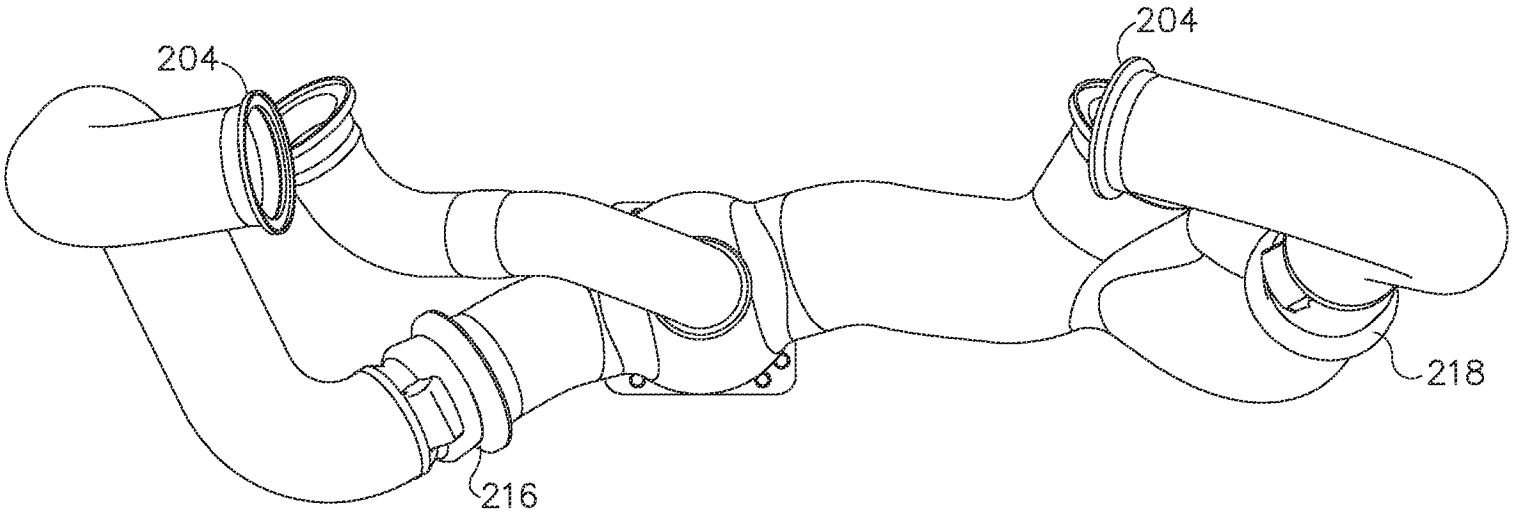
FIG. 4 is a plan view of the portion of aircraft air management systems (AMS) supply source shown in FIG. 3.
Figure 5:
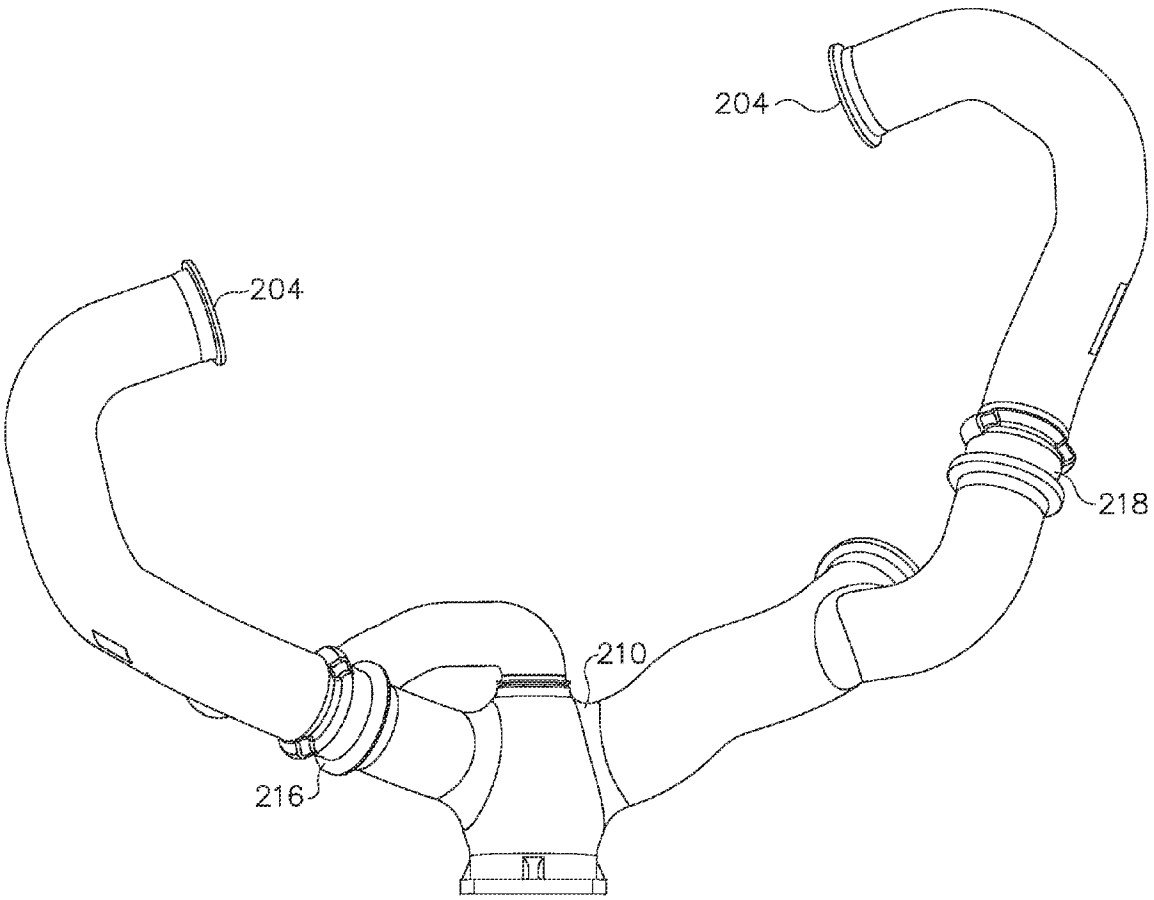
FIG. 5 is an elevation view of the portion of aircraft air management systems (AMS) supply source shown in FIG. 2.

FIG. 3 is a three dimensional (3D) isometric piping view of a portion of aircraft air management systems (AMS) supply source 200 (shown in FIG. 2). FIG. 4 is a plan view of the portion of aircraft air management systems (AMS) supply source 200 (shown in FIG. 3). FIG. 5 is an elevation view of the portion of aircraft air management systems (AMS) supply source 200 (shown in FIG. 2).

Figure 6:
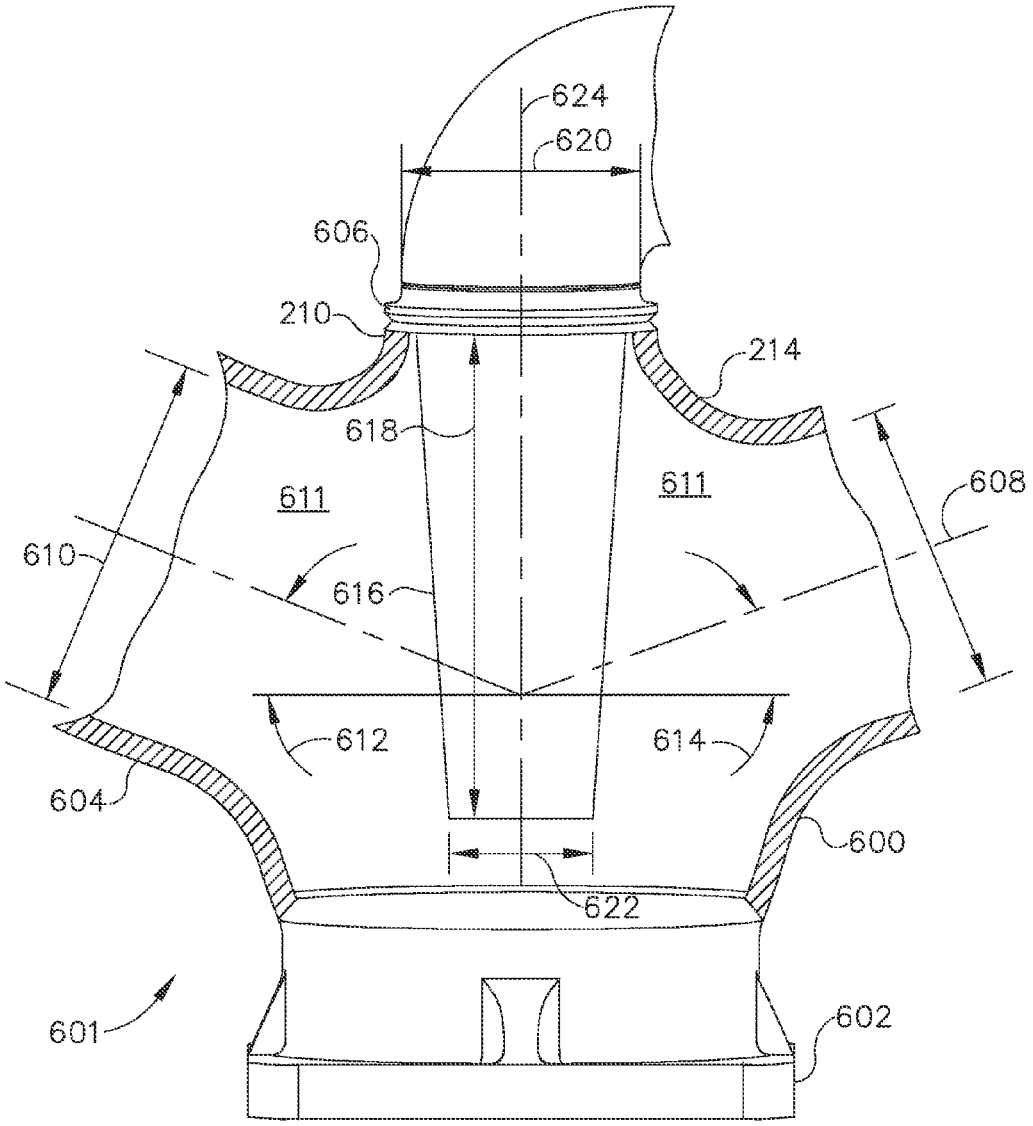
FIG. 6 is a side elevation view of a mixing bowl with parts partially cut away.

FIG. 6 is a side elevation view of a mixing bowl 601 with parts partially cut away. In the example embodiment, mixing bowl 601 includes a body 600 including a jet pump connecting flange 602, first inlet connection 214, a second inlet connection 604, and a nozzle supply connection 606. First inlet connection 214 and second inlet connection 604 each includes a diameter 608 and 610, respectively. In the example embodiment, diameter 608 is smaller than diameter 610 to provide air to jet pump 205 from two different locations at two different velocities. Multiple inlets of different diameters (but close to a 50-50 flow split) permits the higher velocity low-pressure flow to pre-swirl the lower velocity low-pressure flow prior to the introduction of the high-pressure flow (i.e. pre-boost the low-pressure flow to better produce a swirl in mixing bowl 601. Additionally, first inlet connection 214 is configured to direct flow into a mixing section 611 at a first inlet angle 612 and second inlet connection 604 is configured to direct flow into mixing section 611 at a second inlet angle 614. Delivering air to mixing section 611 from substantially opposite directions, at different velocities, and at a predetermined inlet angle promotes swirl and mixing to occur within mixing section 611 and into mixing tube 209 (shown in FIG. 2). A nozzle 616 receives air from high-pressure compressor $10^{th}$ stage bleed ports 202, accelerates the air into jet pump 205. Nozzle 616 includes a length 618, an inlet diameter 620, an outlet diameter 622, and a central axis 624.

Figure 7:
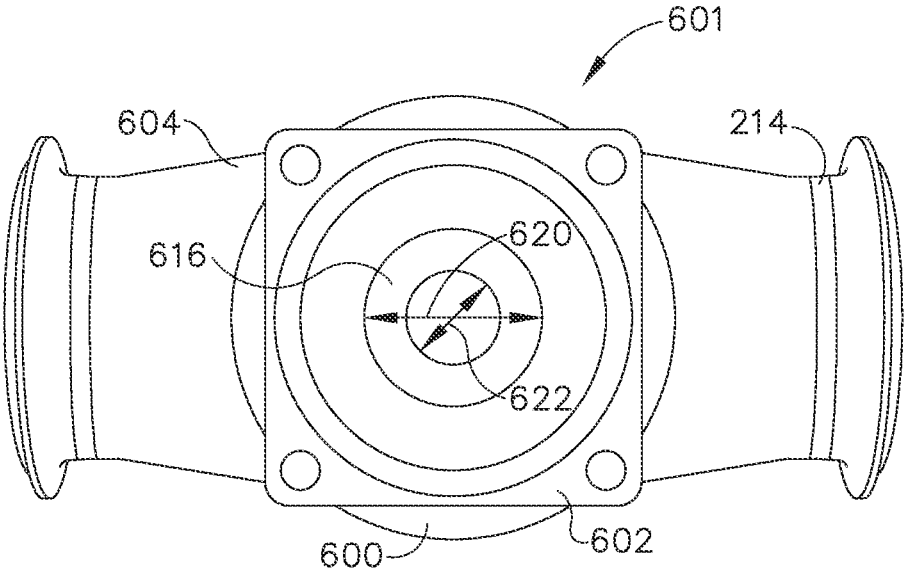
FIG. 7 is a view of the mixing bowl from below looking up into the jet pump connecting flange with the nozzle having a conical shape as shown in FIG. 6.
Figure 8:
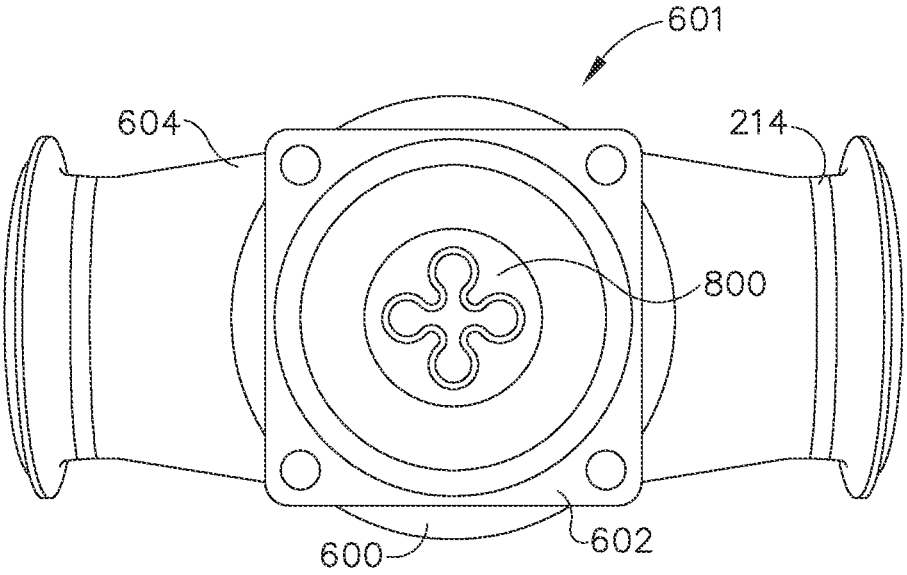
FIG. 8 is a view of the mixing bowl from below looking up into the jet pump connecting flange with a nozzle having a lobed-shape.

FIG. 7 is a view of mixing bowl 601 from below looking up into jet pump connecting flange 602 with nozzle 616 having a conical shape as shown in FIG. 6. FIG. 8 is a view of mixing bowl 601 from below looking up into jet pump connecting flange 602 with a nozzle 800 having a lobed-shape. The lobed-shaped simulates a multi-port ejector that effectively lengthens a shear layer between high-pressure and low-pressure streams resulting in reduced losses. Additionally, other shapes than lobed are possible and shapes with more or less lobes are also possible.

Figure 9:
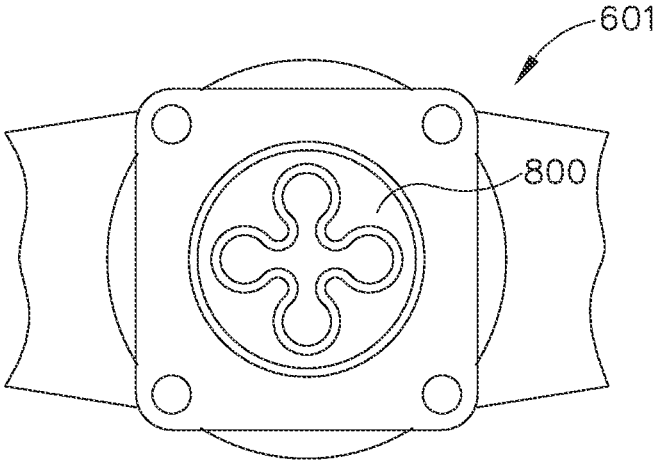
FIG. 9 is a plan view of the mixing bowl with the nozzle having the lobed-shape as shown in FIG. 8 to generate additional flow shear between the LP and HP streams.
Figure 10:
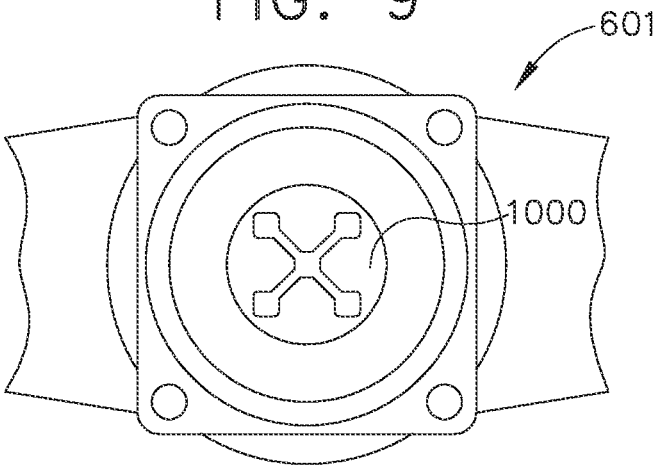
FIG. 10 is a plan view of the mixing bowl with the nozzle having an alternate shape that also increases flow shear.
Figure 11:
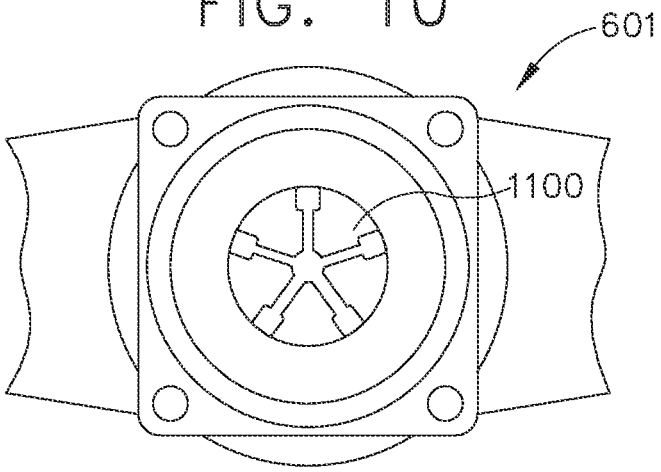
FIG. 11 is a plan view of the mixing bowl with the nozzle having another alternate shape that also increases flow shear.

FIG. 9 is a plan view of mixing bowl 601 with nozzle 800 having the lobed-shape as shown in FIG. 8. FIG. 10 is a plan view of mixing bowl 601 with nozzle 1000 having an alternate shape that also increases flow shear. FIG. 11 is a plan view of mixing bowl 601 with nozzle 1100 having another alternate shape that also increases flow shear.

Figure 12:
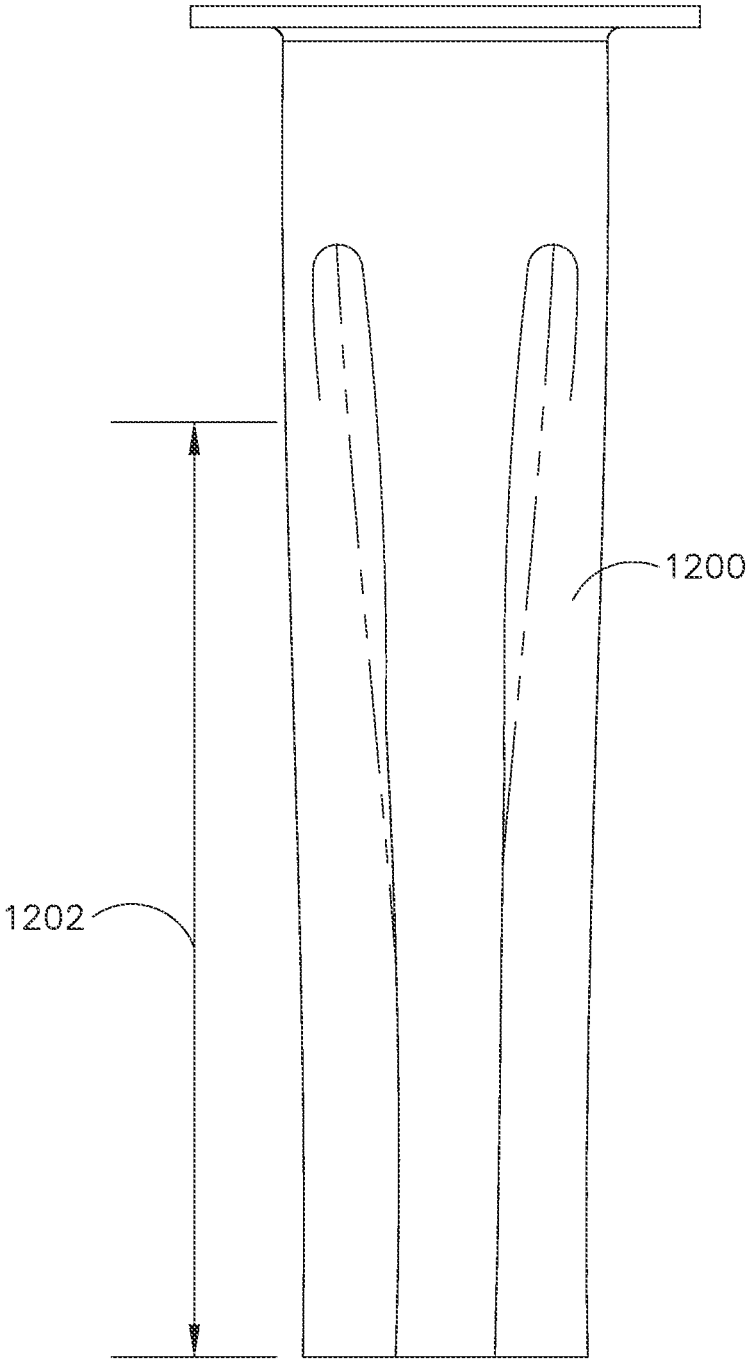
FIG. 12 is a side elevation view of a nozzle including a helical lobed-shape.

FIG. 12 is a side elevation view of a nozzle 1200 including a helical lobed-shape. The lobes are twisted along their length 1202 to promote swirl in the high-pressure stream and low-pressure stream with additional improvements to the mixing length.

Figure 13:
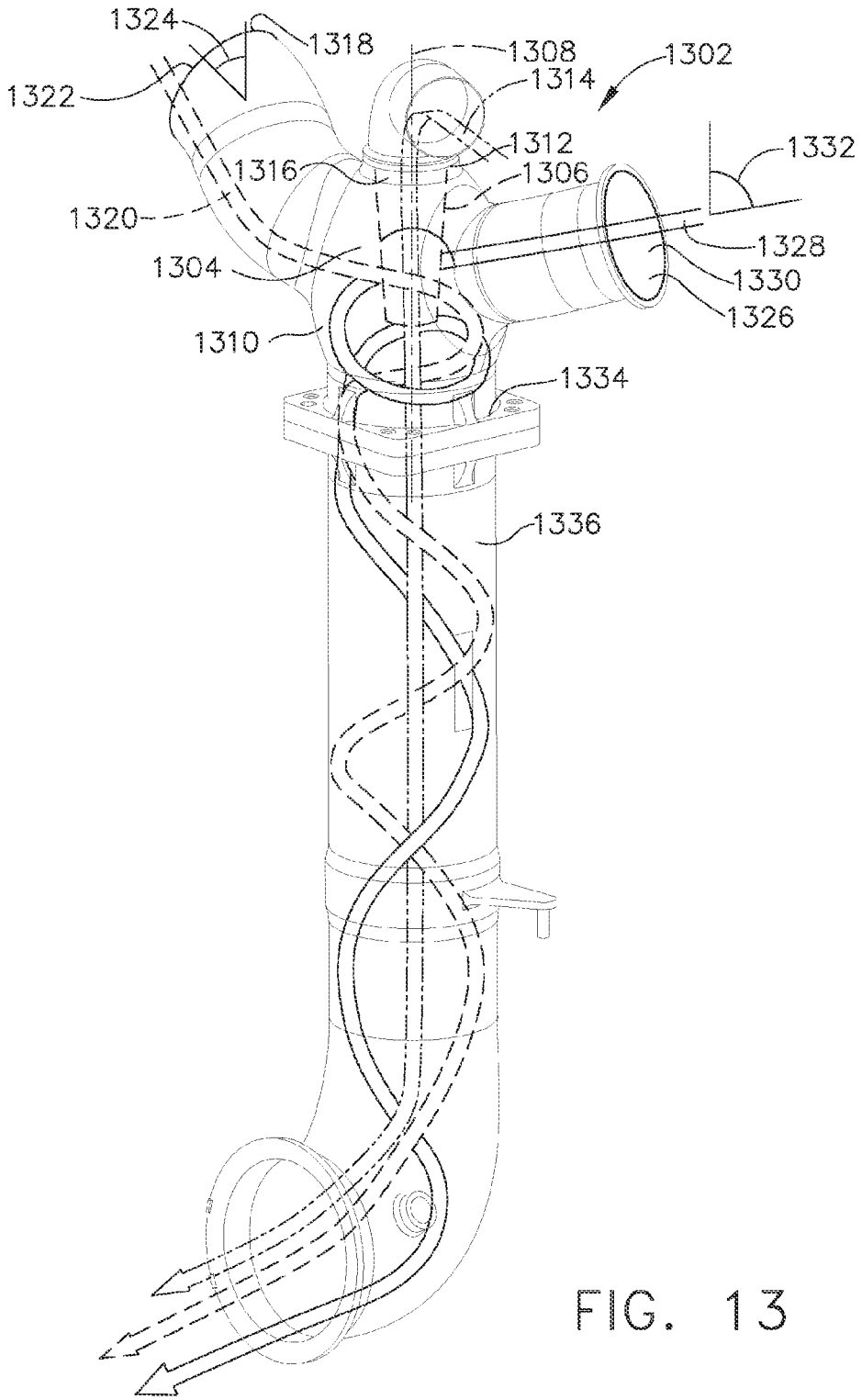
FIG. 13 is a 3D isometric view showing mixed flow through a jet pump in accordance with an example embodiment of the present disclosure.

FIG. 13 is a 3D isometric view showing mixed flow through a jet pump 1302 in accordance with an example embodiment of the present disclosure. In the example embodiment, jet pump 1302 includes a pre-mixing bowl 1304. Pre-mixing bowl 1304 includes a nozzle 1306 having central axis 1308, a mixing section 1310 at least partially surrounding nozzle 1306, first inlet opening or nozzle supply connection 1312 configured to receive a first flow of fluid 1314 from a first pressurized fluid source (not shown) and to direct first flow of fluid 1314 to an inlet 1316 of nozzle 1306.

Pre-mixing bowl 1304 also includes a second inlet opening 1318 configured to receive a second flow of fluid 1320 from a second pressurized fluid source (not shown) and to direct second flow of fluid 1320 into mixing section 1310. Second inlet opening 1318 includes a first inlet opening area 1322 and is oriented with an entry angle 1324 into pre-mixing bowl 1304 that is oblique with respect to central axis 1308.

A third inlet opening 1326 is configured to receive a third flow of fluid 1328 from the second pressurized fluid source (not shown) and to direct third flow of fluid 1328 to mixing section 1310. Third inlet opening 1326 includes a second inlet opening area 1330 and an entry angle 1332 into pre-mixing bowl 1304 that is oblique with respect to central axis 1308. An outlet opening 1334 is configured to direct first flow, second flow 1320 and third flow 1328 from pre-mixing bowl 1304 into a mixing tube 1336 extending from outlet opening 1334 aligned with central axis 1308. Because of the different diameters or different areas of the inlet openings for the legs of the low-pressure flows and because the openings are oriented at angle that directs the flow towards the outlet, and because of the non-uniform flow gradient across the inlet openings generated by the predetermined bends of the inlet piping, the two low-pressure flows interact in a pre-swirl flow in pre-mixing bowl 1304 that facilitates maintaining a coherence at the HP center jet at the mixing section entrance, allowing a shorter central nozzle. Such a configuration permits a lighter weight jet pump having an increased effective mixing length with less losses associated with the LP flow and an improved back-flow margin. Conic central nozzle 1306 improves swirl generation by inducing non-uniform inlet low-pressure flow fields to flow around the central blockage of the mixing section. Nozzle 1306 is also configured to maximize a flow shear between LP and HP flow using a lobed configuration, which approximates a compact and lightweight multi-port ejector. In various embodiments, other nozzle shapes and designs can meet the same objective. The helix lobed configuration also generates additional HP swirl and additional mixing effectiveness in an even shorter mixing section and generates additional LP swirl at the same time. The jet pump system describe herein operates efficiently across the entire range of engine power levels, and across a broad range of LP/HP pressure ratios.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An aircraft air management system (AMS) comprising:

a first pressurized fluid source of relatively higher pressure air;

a second pressurized fluid source of relatively lower pressure air than the first pressurized fluid source; and a jet pump, wherein the jet pump includes a pre-mixing bowl comprising:

a nozzle comprising a central axis;

a mixing section at least partially surrounding said nozzle;

a first inlet opening configured to receive a first flow of fluid from the first pressurized fluid source and direct the first flow of fluid to an inlet of said nozzle; and a second inlet opening configured to receive a second flow of fluid from the second pressurized fluid source and to direct the second flow of fluid to said mixing section, said second inlet opening comprising a first inlet opening area, said second inlet opening comprising an entry angle into said pre-mixing bowl that is oblique with respect to the central axis;

a third inlet opening configured to receive a third flow of fluid from the second pressurized fluid source and to direct the third flow of fluid to said mixing section, said third inlet opening comprising a second inlet opening area, said third inlet opening comprising an entry angle into said pre-mixing bowl that is oblique with respect to the central axis; and an outlet opening configured to direct the first, second and third flows of fluid from said pre-mixing bowl; and a mixing tube extending from said outlet opening aligned with the central axis.

2. The air management system of claim 1, wherein said nozzle comprises a conical shape.

3. The air management system of claim 1, wherein said nozzle comprises a plurality of lobed passages.

4. The air management system of claim 3, wherein said plurality of lobed passages extend helically along the central axis and define a helical flow path through said nozzle.

5. The air management system of claim 3, wherein at least one of said plurality of lobed passages comprises a polygonal cross-section.

6. The air management system of claim 3, wherein at least one of said plurality of lobed passages comprises a cross-section having arcuate portions.

7. The air management system of claim 1, wherein first inlet opening is configured to selectively receive a modulated flow of fluid from said first pressurized fluid source.

8. The air management system of claim 1, wherein at least one of said second and said third inlet openings are configured to receive an inlet flow of fluid having a non-uniform flow gradient across a face of said opening.

9. The air management system of claim 1, wherein an area of said second opening and an area of said third inlet opening are different with respect to each other.

10. The air management system of claim 1, wherein said second inlet opening and said third inlet opening are angled with respect to the central axis to direct their respective flows toward said outlet opening.

11. The air management system of claim 1, wherein the first inlet opening area is larger than the second inlet opening such that a velocity of the flow of fluid though said second inlet opening is greater than the flow of fluid though said first inlet opening, the uneven flow between said first inlet opening and said second inlet opening promoting a swirl in said pre-mixing bowl.

12. An aircraft comprising an air management system (AMS), said AMS comprising:

a jet pump apparatus comprising:

a pre-mixing bowl comprising:

a nozzle comprising a central axis;

a mixing section at least partially surrounding said nozzle;

a first inlet opening configured to receive a first flow of fluid from a first pressurized fluid source and direct the first flow of fluid to an inlet of said nozzle; and a second inlet opening configured to receive a second flow of fluid from a second pressurized fluid source and to direct the second flow of fluid to said mixing section, said second inlet opening comprising a first inlet opening area, said second inlet opening comprising an entry angle into said pre-mixing bowl that is oblique with respect to the central axis;

a third inlet opening configured to receive a third flow of fluid from the second pressurized fluid source and to direct the third flow of fluid to said mixing section, said third inlet opening comprising a second inlet opening area, said third inlet opening comprising an entry angle into said pre-mixing bowl that is oblique with respect to the central axis; and an outlet opening configured to direct the first, second and third flows of fluid from said pre-mixing bowl; and a mixing tube extending from said outlet opening aligned with the central axis.

13. The aircraft of claim 12, wherein said nozzle comprises a conical shape.

14. The aircraft of claim 12, wherein said nozzle comprises a plurality of lobed passages.

15. The aircraft of claim 14, wherein said plurality of lobed passages extend helically along the central axis and define a helical flow path through said nozzle.

16. The aircraft of claim 12, wherein an area of said second opening and an area of said third inlet opening are different with respect to each other.

17. The aircraft of claim 12, wherein said second opening and said third inlet opening are angled with respect to the central axis to direct their respective flows toward said outlet opening.

18. The aircraft of claim 12, wherein the first inlet opening area is larger than the second inlet opening such that a velocity of the flow of fluid though said second inlet opening is greater than the flow of fluid though said first inlet opening, the uneven flow between said first inlet opening and said second inlet opening promoting a swirl in said pre-mixing bowl.

* * * * *